US005274552A

United States Patent [19]

Milburn

[11] Patent Number: 5,274,552

[45] Date of Patent: Dec. 28, 1993

[54] DRILL STRING MOTION DETECTION FOR BIT DEPTH CALCULATION

[75] Inventor: John M. Milburn, Cedar Park, Tex.

[73] Assignee: M/D Totco, Cedar Park, Tex.

[21] Appl. No.: 871,294

[22] Filed: Apr. 20, 1992

[51] Int. Cl.[5] ..... G01V 3/18

[52] U.S. Cl. ..... 364/422; 364/562; 73/151.5

[58] Field of Search ..... 364/420, 422, 562, 565; 73/151, 151.5

[56] References Cited

U.S. PATENT DOCUMENTS

| | | | |
|---|---|---|---|
| 3,881,695 | 5/1975 | Joubert | 73/151.5 |
| 3,931,735 | 1/1976 | Guigmard | 73/151.5 |
| 4,156,467 | 5/1979 | Patton et al. | 73/151.5 |
| 4,434,971 | 3/1984 | Cordrey | 364/562 |
| 4,610,005 | 9/1986 | Utasi | 73/151.5 |
| 4,616,321 | 10/1986 | Chan | 364/422 |
| 4,736,297 | 4/1988 | LeJeune | 73/151.5 |
| 4,787,244 | 11/1988 | Mikolajczyk | 73/151 |
| 4,852,665 | 8/1989 | Peltier et al. | 73/151 |
| 4,976,143 | 12/1990 | Casso | 73/151.5 |

*Primary Examiner*—Roy N. Envall, Jr.
*Assistant Examiner*—Jennifer L. Hazard
*Attorney, Agent, or Firm*—Christie, Parker & Hale

[57] ABSTRACT

A motion detector is incorporated on a drilling rig for detection of drill string motion. An output of the motion detector provides an enabling signal for conversion of block height data to bit depth drill string velocity or penetration rate without errors associated with block motion during static drill string conditions.

5 Claims, 3 Drawing Sheets

DRILL STRING MOTION DETECTION FOR BIT DEPTH CALCULATION

BACKGROUND OF HE INVENTION

A. Field of the Invention

The present invention is related to oil and gas well drilling operations and more particularly to determining the condition to update the bit depth value based on travelling block motion above a drilling rig floor and motion of the drill string.

B. Description of the prior art

Oil and gas wells are drilled by means of drilling rigs. The drilling rig generally consists of a mast or derrick that is mounted over a rig floor and a substructure. The drill string is moved vertically in the rig by a block and tackle arrangement suspended from the mast, which includes a crown block mounted near the top of the mast or derrick and a travelling block that is movable with respect to the crown block by a cable. The cable is strung between the crown block and the travelling block and the end of the cable is carried by a drawworks drum. The change in the block height when the drawworks drum is rotated is approximately equal to the amount of cable paid out or taken in by the drawworks divided by the number of lines strung between the crown block and the travelling block.

An important parameter during well drilling is the position of the travelling block above the rig floor. This position can be differentiated with respect to time to indicate the velocity of the drill string during tripping and the rate of penetration during drilling. The value of block height may also be accumulated to indicate the depth of the drill bit.

Motion of the traveling block may be associated with drilling operations in which the drill string does not move. For example, in tripping the string, the traveling block may transition through several up and down motions for each connection or disconnection of pipe sections in the drill string. Consequently, if bit depth measurement employed only position of the traveling block while ignoring actual motion of the drill string, significant errors could result. Therefore, only changes in block height, which accompany actual drill string motion, should be incorporated into the bit depth and bit rate calculations.

An example of a system developed for calculating the block height is described in a patent application, serial no. 07/762,745, titled "METHOD AND APPARATUS FOR DETERMINING THE HEIGHT OF A TRAVELLING BLOCK ABOVE A RIG FLOOR."

A detection of hook load has traditionally been used to determine if the drill pipe is connected to the travelling block. However, it becomes very difficult to determine the presence of the drill pipe if the pipe is very short and light. Furthermore, the error of calculation increases when the drill pipe is farther away from the rig floor. The sensitivity of the hook load transducer becomes less capable of detecting changes due to the large weight span of the pipe. The present invention avoids such insensitivities and is unaffected by the weight restrictions and ambient conditions.

SUMMARY OF THE INVENTION

The present invention includes in combination elements for measurement of travelling block height, detection of drill pipe motion, and calculation to determine the bit depth value, drill string velocity, and rate of penetration. The present invention is used in an oil and gas drilling rig with a measuring system employing a drawworks and a method to determine the height of the travelling block, a detecting system employing a sensor installed underneath the rig floor to determine the motion of the drill pipe, and a computer system to compute the bit depth value.

DESCRIPTION OF THE PREFERRED EMBODIMENT

Figure 1:
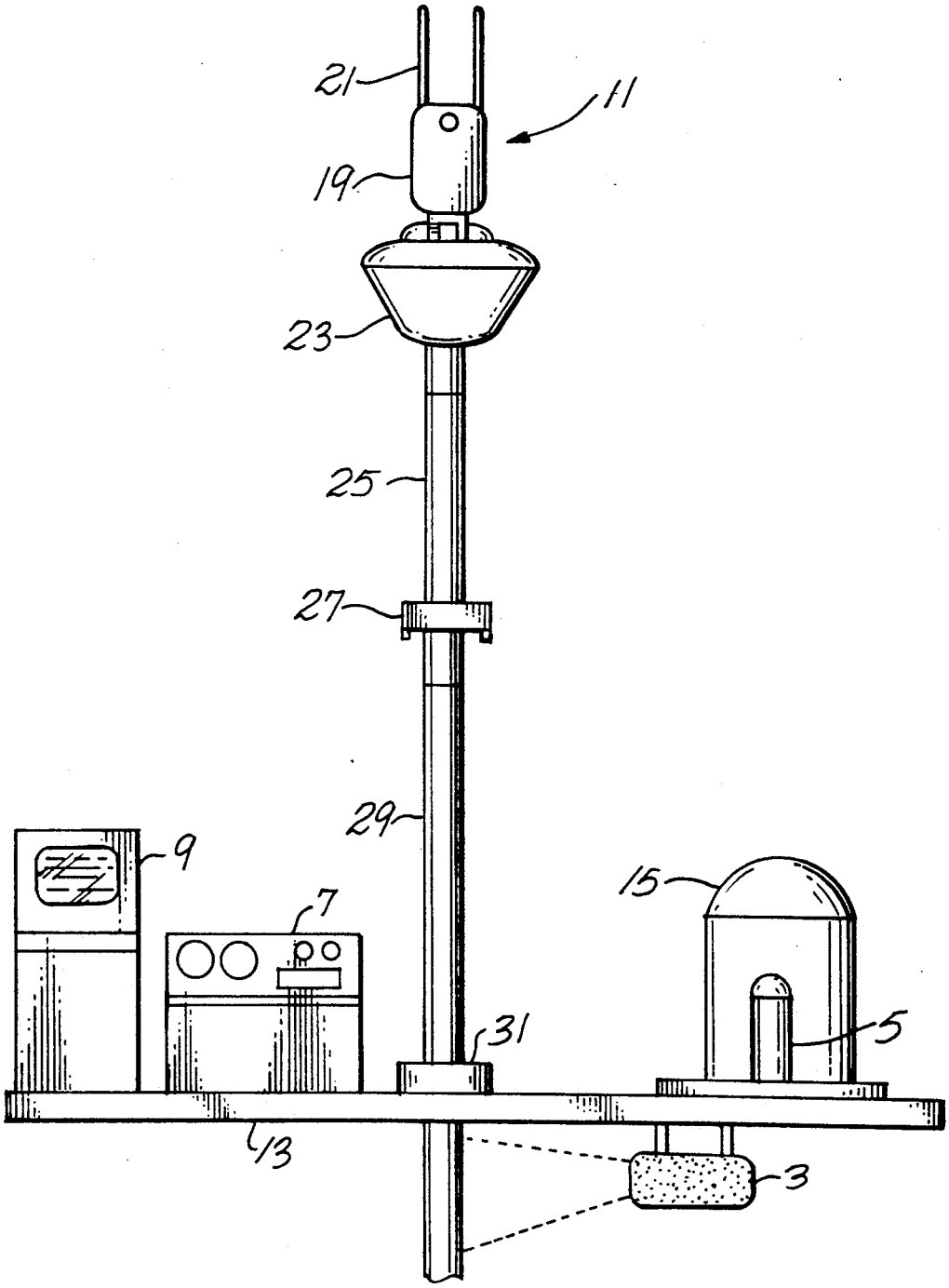
FIG. 1 is a schematic view of a drilling rig with a position sensor of the present invention.

A system equipped with the present invention is shown in FIG. 1. The drilling rig 11 includes a rig floor 13 and a derrick or mast (not shown). A drawworks 15 provides cable for operation of the drill rig. A crown block (not shown) is suspended in a derrick and a travelling block 19 is suspended from crown block by a cable 21. Travelling block 19 is further connected to a swivel 23, a kelly 25, and a rotary bushing 27, where a drill pipe 29 is inserted. A rotary table 31 is installed in the rig floor. A sensor 3 comprising a microwave transceiver in the embodiment shown in the drawings is positioned adjacent to the drill pipe where it exits the rotary table immediately under the rig floor. The microwave transceiver is housed within a weatherproof fiberglass enclosure and mounted to the rig floor or other appropriate structure.

When the pipe moves up or down the sensor detects this motion and locks on to the target drill pipe. The detection of drill pipe vertical movement provides an independent source of information for enabling accurate computation of the drill bit position within the well bore, which is automatic. The sensor utilized in the embodiment shown in the drawings is an AlphaSensor MSM10200 manufactured by Alpha Industries, Inc., and its operation is further described in their publication No. 50050400. The AlphaSensor MSM10200 is a low power microwave transceiver incorporating a Gunn diode mounted in a wave guide as a transmitter, a microwave mixer diode as a receiver, and an oscillator output focused by one of two horn antennas.

The microwave transceiver is installed and pointed towards the drill pipe and as part of the integration a calibration is performed. First the sensitivity adjustment is made to adjust the distance from the microwave sensor to the drill pipe. Second the threshold is adjusted to cause the sensor to indicate the detected motion of the drill pipe and to ignore any other outside interference. Third the hold-off adjustment is made to adjust the time that motion must be sensed before a detection is indicated. And lastly the hold-on adjustment is made to adjust the time that a motion continues to be sensed after the motion is stopped.

Referring to FIG. 1 again, when the calibration is completed the sensor is ready for operation with a depth measurement system incorporating a drawworks encoder 5, and a host computer 9. The depth measurement system employs an algorithm for calculation of travelling block height and a sensor module providing angle information for the position of the drawworks drum. The host computer is a general personal computer.

Figure 2:
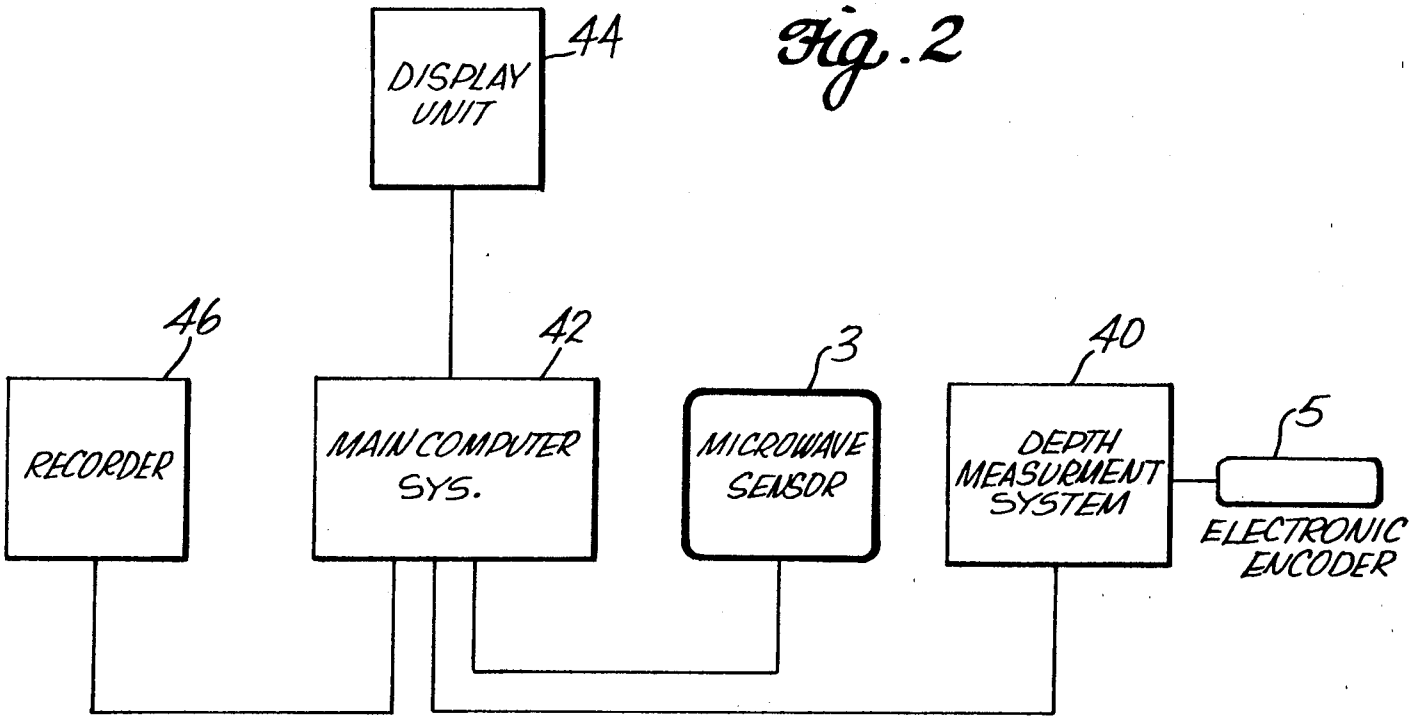
FIG. 2 is a block diagram of the system of the present invention.

In the embodiment of the invention shown in the drawings, the system employed for measurement of block height is an Electronic Depth Measurement System or EDMS. As shown in block diagram in FIG. 2, the EDMS incorporates an optical sensor module, which is a part of the drawworks encoder, which is integrated with the drawworks shaft to sense the angular position of the shaft as the drawworks rotates to take up or play out cable to the rig. Data providing the angular position from the sensor module is converted to digital format by a depth measurement system 40 and then sent to a main computer system 42. The microprocessor incorporated within the main computer converts the angular position to a cable length and compensates for drum wraps, lines strung, rope lay anomalies, and cable stretch to accurately determine the traveling block position. Operation of the microwave sensor 3 incorporated as an element of the present invention acts to disable calculation of bit depth, drill string velocity, or penetration rate by the microprocessor unless the drill string is in motion. If the microwave sensor detects motion of the drill string, the block height information is employed by the microprocessor to complete those calculations. The EDMS microprocessor then provides outputs for actual block height, bit depth, and penetration rate. These data from the main computer system then can be displayed to a display unit 44 or be recorded in a permanent format by a recorder 46.

Operation for the invention as embodied in the drawings is accomplished as follows: the driller turns the drawworks so the blocks start to move. The drawworks encoder sends a signal to the depth measurement system which produces the block height measurement signals. The measurement from the device is sent to the main computer, referring to FIG. 2. When the pipe is in motion the microwave system also sends a signal to the main computer.

Figure 3:
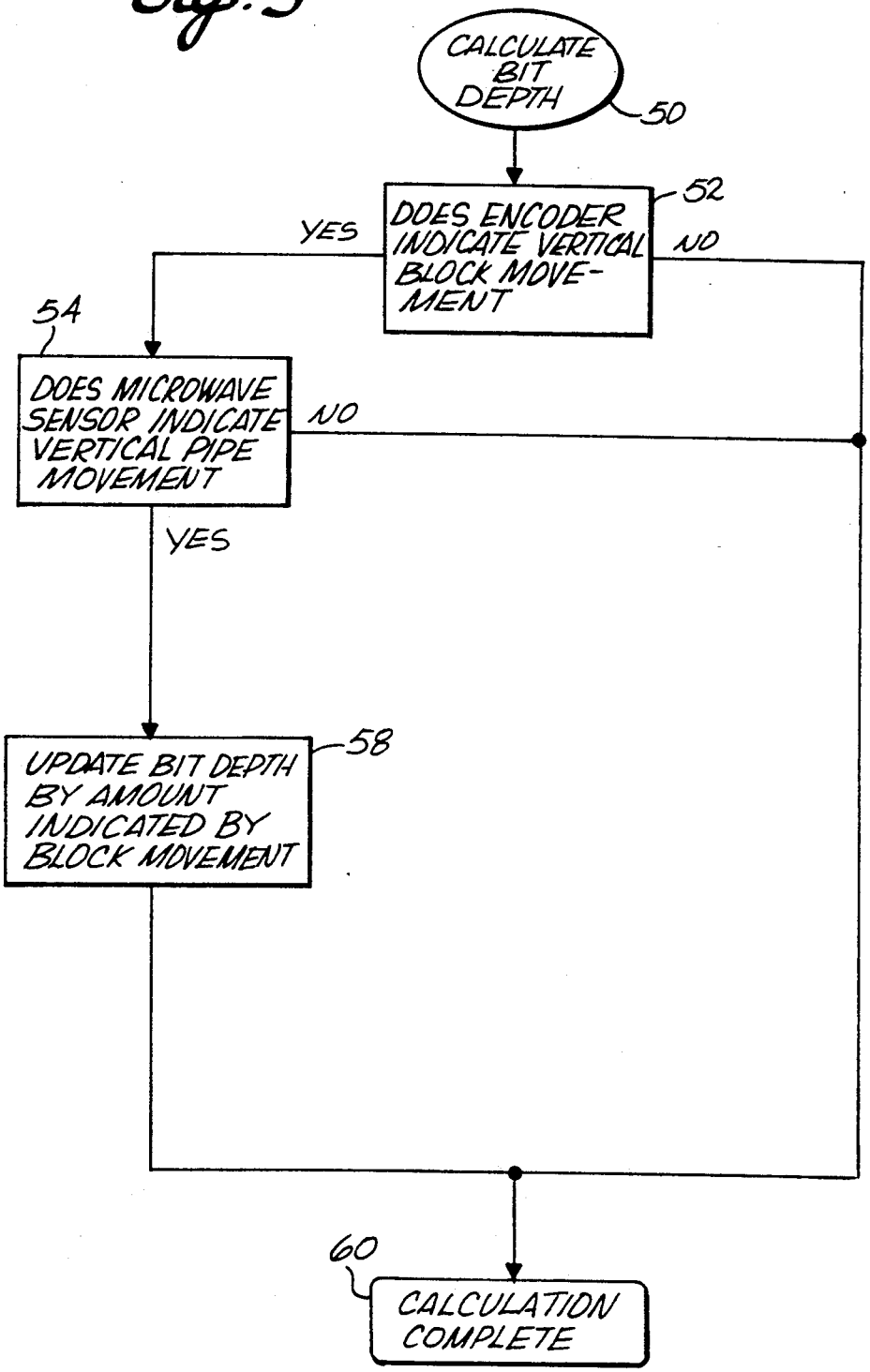
FIG. 3 is a logic flow diagram of the system of the present invention.

As indicated in logic flow diagram in FIG. 3, the main computer system will start a computation from block 50. If an indication of a vertical block movement by the encoder occurs, as shown in block 52, the computation will proceed to block 54. If there is no indication of vertical block movement the computation will complete and stop at block 60. From block 54 if an indication of a vertical pipe movement by the microwave sensor exists the computation will enter block 58, otherwise the computation will again complete at block 60. An update of bit depth by the amount indicated by the block movement will follow in block 58, and the computation will complete at block 60.

Operation of the calculations previously described with respect to FIG. 3 are accomplished in the embodiment shown in the drawings through software or firm ware for the microprocessor. An exemplary software routine receiving the inputs from the shaft encoder and the microwave sensor is included as Appendix A to the application. The routine described provides for operator determination of the various sensor inputs and direction for bit depth calculation. Alternate embodiments of the software routine incorporate automatic testing of the encoder and microwave sensor inputs to eliminate the need for operator monitoring of the system.

The invention has been described in an exemplary and preferred embodiment, but it is not limited thereto. Those skilled in the art will recognize that additional modifications and improvements can be made to the invention without departure from its essential spirit and scope.

What is claimed is:

1. A system for determining drill string travel using travelling block height above a drilling rig floor, the system comprising:

means for measuring the block height, said measuring means providing an output, means mounted beneath the rig floor for detecting movement of a drill pipe, said detecting means providing an output, calculation means receiving the output of the measuring means and the output of the detecting means, said calculation means having means for calculating distance traveled by the drill string operating on the output from the measuring means, and means for enabling the calculating means responsive to the output of the detecting means.

2. A system as defined in claim 1, further comprising means for receiving the output of the calculation means for computing a bit depth value, a drill string velocity, and a rate of penetration.

3. A system as defined in claim 1, including a drawworks having a drawworks drum about which a plurality of layers of cable are wrapped, wherein the measuring means comprises:

an encoder attached to the drawworks, said encoder providing an output, means for digitizing the output of said encoder, and means for determining the height of the travelling block based on the output of said encoder.

4. A system as defined in claim 1, wherein the detecting means is a microwave transceiver installed beneath the drilling rig floor and aimed at the drill pipe for detecting movement of the drill pipe.

5. A system for determining drill string travel for a drilling rig having a floor incorporating a rotary table, a drawworks, and a traveling block, the system comprising:

an encoder attached to the drawworks, said encoder providing an output representative of the traveling block height;

a motion detector mounted beneath a rig floor, said motion detector detecting vertical movement of a drill string suspended from the traveling block and extending through the rotary table, said motion detector providing an output upon detection of vertical motion of the drill string;

calculating means receiving the output of the encoder for calculating block height above the rig floor; and means for converting the calculated block height to a distance travelled by the drill string, said converting means enabled by an output signal from the motion detector, whereby conversion of a change in block height to a change in drill string position is not made unless the drill string has actually moved.

* * * * *